US007087098B2

(12) United States Patent
Garnier et al.

(10) Patent No.: US 7,087,098 B2
(45) Date of Patent: Aug. 8, 2006

(54) METHOD AND INSTALLATION FOR GASIFYING CARBONACEOUS COMPOUNDS

(75) Inventors: André Garnier, 1100, Chemin de la Tite, F-33290 Le Pian Médoc (FR); Jacques Proot, 109 Grace St., Darlington, SC (US) 29532

(73) Assignees: Agriculture Azote et Carbone Organiques, Le Pian Medoc (FR); Andre Garnier, Le Pian Medoc (FR); Jacques Proot, Darlington, SC (US)

( * ) Notice: Subject to any disclaimer, the term of this patent is extended or adjusted under 35 U.S.C. 154(b) by 525 days.

(21) Appl. No.: 10/148,753

(22) PCT Filed: Dec. 1, 2000

(86) PCT No.: PCT/FR00/03360

§ 371 (c)(1),
(2), (4) Date: Sep. 11, 2002

(87) PCT Pub. No.: WO01/40411

PCT Pub. Date: Jun. 7, 2001

(65) Prior Publication Data

US 2003/0056438 A1 Mar. 27, 2003

(30) Foreign Application Priority Data

Dec. 3, 1999 (FR) ..... 99 15246

(51) Int. Cl.
*C10L 3/00* (2006.01)

(52) U.S. Cl. ..... 48/197 FM; 48/64; 48/25; 48/98; 48/111; 48/74

(58) Field of Classification Search ..... 48/111, 48/197 R, 25, 92
See application file for complete search history.

(56) References Cited

U.S. PATENT DOCUMENTS

| | | | | |
|---|---|---|---|---|
| 3,089,766 | A * | 5/1963 | De Wald et al. | 75/575 |
| 3,729,298 | A * | 4/1973 | Anderson | 48/111 |
| 3,966,457 | A * | 6/1976 | Limpach et al. | 75/460 |
| 4,423,704 | A | 1/1984 | Persinger | 123/25 R |
| 5,656,042 | A | 8/1997 | Kahn et al. | 48/197 R |
| 6,126,907 | A * | 10/2000 | Wada | 422/184.1 |

FOREIGN PATENT DOCUMENTS

| | | |
|---|---|---|
| EP | 0 175 207 A | 3/1986 |
| FR | 2 445 364 A | 7/1980 |

* cited by examiner

*Primary Examiner*—Glenn Caldarola
*Assistant Examiner*—Vinit H. Patel
(74) *Attorney, Agent, or Firm*—Weingarten, Schurgin, Gagnebin & Lebovici LLP

(57) ABSTRACT

The invention relates to a method of gasifying carbon-containing compounds incorporating mineral elements and/or potential contaminants, and it also relates to a gasification installation having means for containing a bath of molten slag, means for charging said compounds into said bath, means for injecting at least oxidizer into the bath so that the mixture of carbon-containing compounds and oxidizer is super-stoichiometric, whereby a first fraction of the compounds is pyrolyzed, a second fraction is subjected to a combustion reaction suitable for delivering heat energy to the bath of slag, and a third fraction diffuses into the bath, means for recovering the gas given off by the pyrolysis and the combustion of the first and second fractions, and means for lowering the temperature of a portion of the molten slag so as to allow it to solidify, thereby immobilizing at least a portion of the third fraction of the compounds containing mineral elements and/or potential contaminants.

24 Claims, 2 Drawing Sheets

FIG.2
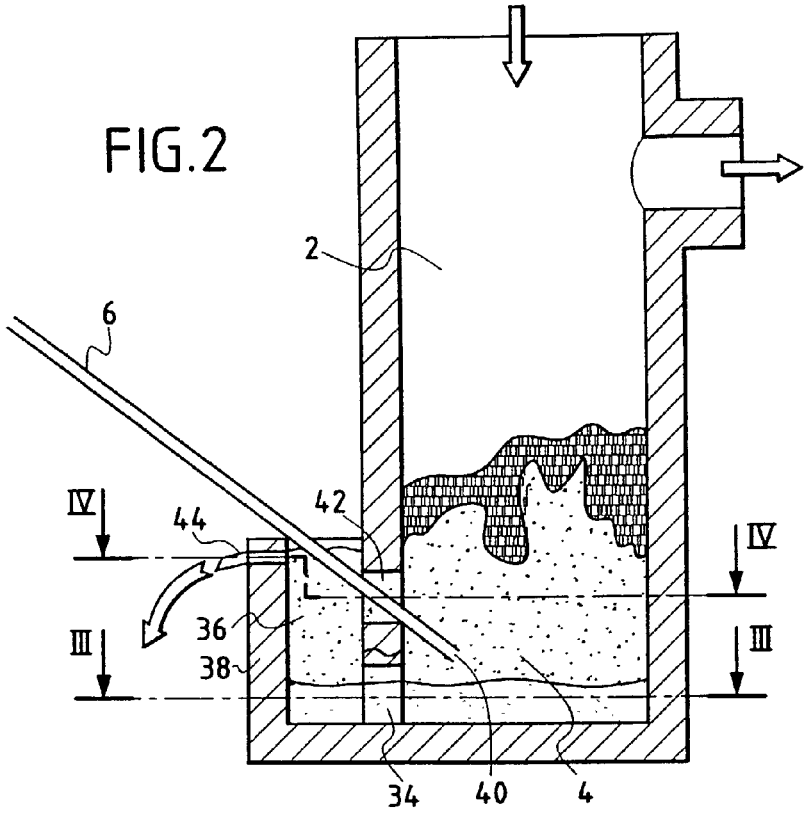
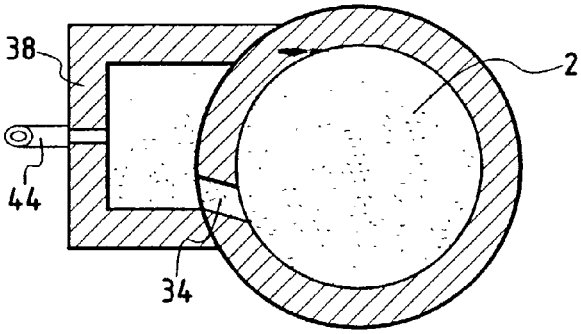
FIG.3
FIG.4
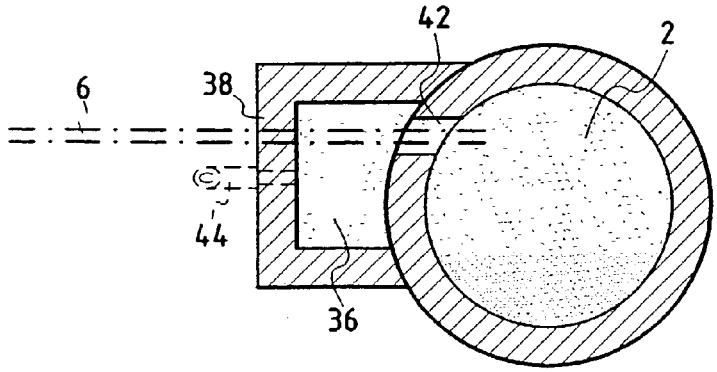

METHOD AND INSTALLATION FOR GASIFYING CARBONACEOUS COMPOUNDS

The present invention relates to a method of gasifying compounds of the type containing carbon, and more particularly compounds that also contain mineral elements and/or potential contaminants. The present invention also relates to an installation for implementing the method.

An intended field of application lies particularly in recycling organochemical, or petrochemical, and treated-wood residues.

Methods of gasifying carbon-containing compounds are well known and lead to various gases being produced as a function of the initial ingredients and the temperature conditions in which the chemical reactions take place. These reactions include the following in particular:

$$C+O_2=CO_2$$

$$C+\tfrac{1}{2}O_2=CO$$

$$C+CO_2=2CO$$

$$C+H_2O=CO+H_2$$

$$CO+H_2O\ CO_2+H_2$$

The reactions take place more or less completely and as a general rule they produce a mixture of gases comprising in particular both carbon dioxide and hydrogen.

The Winkler method is well adapted to gasifying coal and it operates with a fluidized bed, enabling a mixture of carbon monoxide and of hydrogen to be produced. However that method is poorly adapted to the intended types of fuel, in particular because particles of wood are easily blown away. Mention can also be made of the Lurgi method, which is fed with granular coal and operates in a fixed bed under pressure, but at low temperature, thereby causing numerous harmful compounds to be given off which must then be recovered by filtering the flue gases in an oil washing column.

Furthermore, in those methods which are specifically designed to produce gas from coal, no provision is made to render inert any contamination or to remove any mineral elements that might be contained in the coal. Unfortunately, the types of fuel envisaged contain mineral elements and above all contaminants, in particular chromium and copper which must be recovered and made inert.

An object of the present invention is to provide a method of gasifying a compound containing mineral elements and/or potential contaminants, in which the mineral elements are removed, together with the contaminants which are made inert.

To achieve this object, the invention provides a method of gasifying compounds, in particular carbon-containing compounds incorporating mineral elements and/or potential contaminants, the method being characterized in that it comprises the following steps:

charging at least said compounds into a bath of molten slag and injecting oxidizer into said bath so that the mixture of carbon-containing compounds and oxidizer is super-stoichiometric, whereby a first fraction of said compounds is pyrolyzed, a second fraction is subjected to a combustion reaction suitable for delivering heat energy to said bath of slag, and a third fraction diffuses into said bath;

recovering the gases that result from the pyrolysis and the combustion of said first and second fractions; and cooling at least a portion of the molten slag so as to solidify it, thereby immobilizing at least a portion of said third fraction of said compounds containing at least the mineral elements and/or the potential contaminants.

Thus, a characteristic of the gasifying method lies in the medium constituted by the molten slag, within which the carbon-containing compounds that might also contain mineral elements and/or potential contaminants are decomposed by pyrolysis. Under the action of a temperature lying in the range 1100° C. to 1500° C. , the carbon-containing compounds form new chemical species producing a synthetic gas while the non-volatile potential contaminants diffuse into the molten slag.

The injected oxidizer and the newly formed chemical species constitute a mixture which, under the effect of temperature, leads to a combustion reaction.

It will be understood that combustion is always exothermal and therefore provides the heat energy needed by the slag to enable it to maintain a high temperature.

Nevertheless, an object of the invention is to produce synthetic gas, and in order to do so the proportions of the carbon-containing compounds, i.e. fuel, and of oxidizer are adjusted so that the mixture is super-stoichiometric. Thus, the quantity of fuel is greater than the quantity of oxidizer available for reacting with it and therefore a first fraction of the carbon-containing compounds is pyrolyzed to provide synthetic gas while a second fraction is burned to deliver energy to the slag.

Both the burned gas and the gas derived from pyrolysis are recovered, but it will be understood that it is only the pyrolysis-derived gas that is of interest, whether as a source of energy or for performing various kinds of synthesis.

In addition, in order to immobilize the contaminants contained in the molten slag, its temperature is lowered by casting it, and subsequently it is granulated. When the method is performed continuously, it is advantageous to lower the temperature of a portion of the molten slag by removing said portion. This operation consists in casting slag either sequentially or continuously.

In order to make the slag inert, and in particular to make up for the removed slag so as to maintain a constant level for the bath, it is advantageous to add flux to the molten slag.

To implement the method, and when so required by the form of the compounds, it is advantageous to prepare said compounds in the form of solid elements so as to enable said elements to be charged vertically over the bath of molten slag, thus enabling said elements to be deposited on the surface of said bath and/or to incorporated therein.

When heterogeneous and volatile materials are introduced above the molten slag, and given the gases that are being given off, the materials run the danger of not reaching the slag directly, and of being carried away with the gases. To mitigate that problem, said compounds are agglomeratized to make solid lumps that are heavy relative to the gases being given off, so as to ensure that said compounds are introduced directly into the slag bath.

When the carbon-containing compounds are sufficiently homogenous and dry, it is preferable for said compounds to be injected simultaneously with the oxidizer into the bath of molten slag.

In advantageous manner, both during starting stages and whenever the quantity of energy delivered to the slag by the combustion of the carbon-containing compounds is too low, it is also possible to inject said oxidizer into said bath of molten slag simultaneously with a fuel so as to produce a combustion reaction to deliver heat energy to said bath and keep it at the desired temperature.

Nevertheless, the object of the present invention is to recover the energy contained in the carbon-containing compounds, and in particular to recover gases, and in accordance with a particular characteristic of the invention said gases are purified so as to obtain a clean fuel gas. The gas can be burned on site in a power station or it can be delivered to a distribution network with or without co-generation.

The gas coming directly from the combustion reaction and the pyrolysis is hot, and in accordance with another particular characteristic, the heat energy, in particular from said gas, is recovered so as to deliver the heat energy to a heat-conveying fluid. In addition, a fourth fraction of said compound vaporized by the bath of molten slag is condensed. Some of the elements contained in the carbon-containing compounds do not participate in the pyrolysis or combustion reactions and they vaporize on coming into contact with the slag. These elements are isolated in the heat exchanger since it is the heat exchanger which contributes to condensing said fourth fraction.

The present invention also provides an installation for gasifying compounds, in particular carbon-containing compounds having a mineral element and/or potential contaminants, said installation comprising:

means for containing a bath of molten slag;

means for charging at least said compounds into said bath of molten slag;

means for injecting at least oxidizer into said bath so that the mixture of carbon-containing compounds and oxidizer is super-stoichiometric whereby a first fraction of said compounds is pyrolyzed, a second fraction is subjected to a combustion reaction suitable for delivering heat energy to said bath of slag, and a third fraction diffuses into said bath;

means for recovering in particular the gases that result from the pyrolysis and the combustion of said first and second fractions; and means for lowering the temperature of at least a portion of the molten slag so as to cause it to solidify, thereby immobilizing at least a portion of said third fraction of said compounds containing at least mineral elements and/or potential contaminants.

In a preferred embodiment of the invention, the bath of molten slag is contained in the bottom portion of a vertical cylindrical furnace having at least one opening pierced through the wall of the top portion of said furnace for charging it with said compounds, and at least one opening pierced through the wall of the bottom portion of said furnace for extracting at least a portion of the molten slag.

It will be understood that the carbon-containing compounds are dropped into the molten slag from the top of the furnace in order to be transformed, and that the same applies to adjusting the slag when a portion is extracted. When the carbon-containing compounds reach the molten slag, they are transformed into gas, and in accordance with the characteristic of the invention, the wall of the top portion of the vertical furnace is pierced by an orifice for collecting at least the gas produced by pyrolysis and by combustion of said first and second portions, and said installation further comprises washing means connected to said orifice to purify said gas.

On leaving the furnace, the gas possesses a large amount of energy since it reaches a temperature that is well above 1100° C. In order to improve the overall efficiency of the installation, a heat exchanger and deposition chambers are interposed between the furnace and the washing means so as to recover at least a portion of the heat energy of said product and so as to recover in condensed form a fourth fraction of the compounds vaporized in the furnace.

The gas escapes via the orifice pierced thorough the top portion and passes through the set of devices so as to obtain clean gas. In order to prevent the gas escaping via the opening that is provided for charging purposes, it is advantageous for the means for charging said compounds to comprise a feed screw opening out above the bath of molten slag and provided with heater means so as to agglomerate the compounds by causing at least one of said compounds to melt. It will be understood that the feed screw located at the opening for charging the furnace enables the enclosure constituted by the furnace to be isolated while it is in operation and contains carbon-containing compounds. The fact that some of the compounds become semisolid and cause other compounds to become agglomerated contributes to ensuring that the feed opening remains impermeable to the bulk of the gas.

This gas results essentially from decomposition of the carbon-containing substances as induced indirectly by the heat given off by burning a fraction of said substances, which combustion requires an oxidizer.

In a particular embodiment, the means for injecting oxidizer into the molten slag comprise a blast pipe passing through the wall in the top portion of the furnace and dipping into the bath of molten slag, and within which the oxidizer is under pressure.

In another particular embodiment, the means for injecting oxidizer into the molten slag comprise a blast pipe passing through the wall constituting the bottom portion of the furnace and opening out into the bath of molten slag, the blast pipe containing oxidizer under pressure.

In both of these embodiments, the end of the blast pipe is immersed in the slag, and the oxidizer under pressure diffuses through the slag in order to react with the fuel.

In the second particular embodiment, the opening pierced through the bottom portion of the wall of said furnace advantageously opens out in a tank adjacent to said furnace and having an open top, the sides of the tank being at least as high as the mean level of the bath of molten slag contained in the bottom portion of said furnace, and said blast pipe is inserted into said open top portion and passes through the wall common to the bottom portion of the furnace and said tank so as to penetrate into the bath of molten slag. These dispositions serve in particular to overcome the difficulties of sealing the place where the blast pipe passes through the wall of said furnace.

In addition, said tank makes it easier to cast slag, in particular in a continuous process, since it suffices to provide a notch in the sides of the tank level with the bath of molten slag. Thus, each time slag is adjusted, its depth increases and consequently a fraction of the molten slag runs off.

Other features and advantages of the invention appear on reading the following description given by way of non-limiting indication and with reference to the accompanying drawings, in which:

FIG. 2 is a simplified vertical section view of the furnace in a particular embodiment of the installation;

FIG. 3 is a diagrammatic section view on plane III—III of FIG. 2; and

FIG. 4 is a diagrammatic section view on plane IV—IV of FIG. 2.

Figure 1:
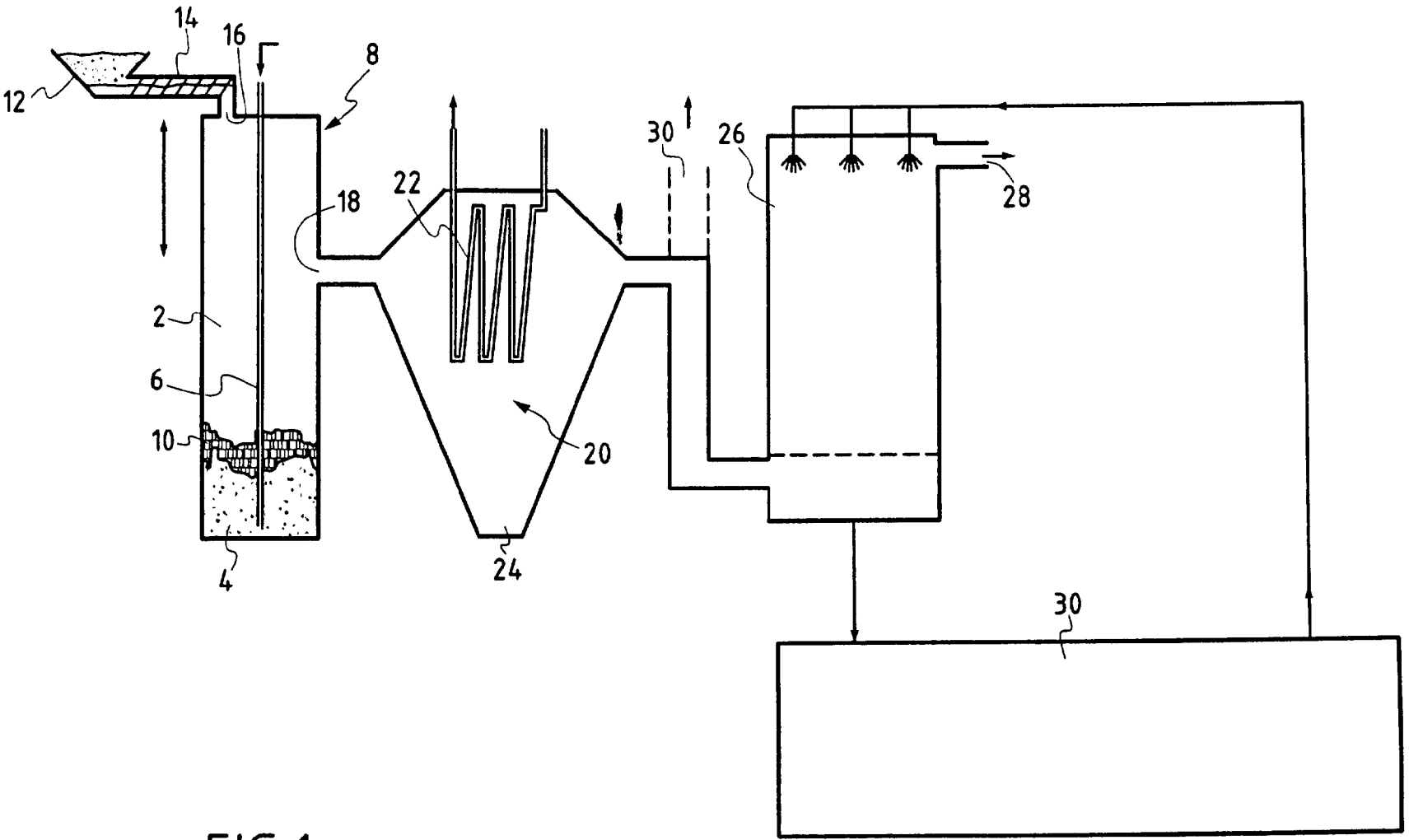
FIG. 1 is an overall diagrammatic view of a gasification installation for implementing the method of the invention.

With reference initially to FIG. 1, there follows a general description of an installation for implementing the gasification method of the invention.

The reactor 2 is referred to as a furnace and constitutes the essential element of the installation since it is within the reactor that all of the transformations of the invention take place.

The furnace 2 is made of refractory material in the form of a vertical cylinder of height greater than its diameter. The diameter of such a furnace is fixed as a function of the quantities of carbon-containing compounds that are to be transformed, and it preferably lies in the range 2 meters (m) to 4 m, making it possible to optimize overall efficiency.

Slag 4 is placed in the bottom portion of the furnace 2 and during an initial stage it is heated by means of a blast pipe 6 with a fuel and an oxidizer burning at the end of the pipe, said fuel and oxidizer being injected under pressure. The end of the blast pipe is thrust into the slag causing it to melt, and as a result the molten slag constitutes a bath whose temperature can lie in the range 1100° C. to 1500° C.

In this embodiment, the blast pipe passes through the wall constituting the top portion 8 of the furnace 2 and the pipe is movable along the axis of the furnace so that its flame can be immersed in the slag. Fuels suitable for this purpose are preferably gas or fuel oil, and the oxidizer is generally pure air or oxygen-enriched air.

In a second stage, i.e. during normal operation, heat energy is delivered to the slag 4 by controlled combustion of the carbon-containing compounds 10 floating on the bath of the slag. These compounds are charged from a hopper 12 onto the bath of slag 4 by means of a feed screw 14.

The carbon-containing compounds that are suitable for being transformed in the furnace 2 are essentially wood and hydrocarbons. The wood used to make posts for supporting low voltage electricity lines or telephone lines is generally treated with hydrosoluble salts, for example solutions of oxides of copper, chromium, and arsenic, and the wood used for railway sleepers or ties is treated with creosote. Such wood and any other wood treated with the same substances is difficult to recycle, and the gasification method of the invention enables the harmful contaminants contained therein to be destroyed or to be recovered and made inert.

The wood is prepared in the form of fragments and the fine fraction thereof is agglomerated using carbochemical or petrochemical residues. Bituminous shale can also be used in this gasification method.

The wood in the form of shavings and sawdust is placed in the hopper 12 together with carbochemical or petrochemical residues so as to form a mixture, said hopper 12 being extended by a feed screw 14 leading to an opening 16 through the wall constituting the top portion 8 of the furnace 2. The feed screw 14 is hermetically connected to the furnace 2 and it is provided with a heater system which surrounds it so that as said mixture passes along the feed screw, the residue softens and together with the shavings and sawdust makes uniform pieces that can be treated as solid lumps.

When these solid lumps come over the opening 16 they drop into the furnace 2 and are deposited onto the surface of the bath of molten slag 4.

When the carbon-containing compounds are initially in the form of lumps or pellets, or when a feed screw is not suitable for charging the fuel, an airlock or any other device for performing the same function is provided so as to enable said compounds to be introduced to the slag 4, while preventing gas from leaking out of the furnace 2.

These lumps made up essentially of carbon-containing compounds 10 decompose under the effect of the heat so as to form new substances, and in particular gases. Some of these compounds, constituting said fourth fraction are vaporized, and this applies in particular to the water and the arsenic. The arsenic is in oxidized form in the burden, but the conditions within the furnace reduce it to the metal state; it therefore condenses in its metal form, thus improving elimination thereof.

The blast pipe 6 which was used during the initial stage for injecting both fuel and oxidizer into the slag 4 so as to deliver combustion energy to said slag, is used during this second stage to deliver the oxidizer needed for controlled combustion of the carbon-containing compounds 10 present on the surface of the bath of molten slag 4. Thus, the controlled combustion of the carbon-containing compounds suffices on its own to deliver the heat energy required for keeping the temperature of the bath in the range 1100° C. to 1500° C.

As during the first stage, the oxidizer is injected from the end of the blast pipe into the core of the slag. As a result, said oxidizer diffuses through said slag 4 and reacts with the carbon-containing compounds 10 in a combustion reaction. The oxidizer is constituted by pure air, by oxygen, or by a mixture thereof, and it is adjusted as a function of the oxidizing properties that are required. The oxidizer flow rate is also adjusted so that the mixture of carbon-containing compounds 10 and oxidizer is super-stoichiometric, thus ensuring that only said second fraction of the carbon-containing compound is burnt to deliver the energy required for keeping the slag melted. The remainder of the carbon-containing compounds, said first fraction, is thus pyrolyzed and forms new substances, and in particular carbon monoxide and hydrogen.

The carbon-containing compounds are likely to contain potential contaminants which spread through the molten slag during decomposition. This applies in particular to chromium and to copper. Chromium forms slag while cooper dissolves in the slag if its concentration is very low, otherwise it serves as a basis for forming a dense phase in metal or other form. In order to immobilize these elements, slag is drawn off at regular intervals or continuously and is then granulated. This takes place through an opening (not shown in FIG. 1) pierced through the wall constituting the bottom portion of the furnace 2. To compensate for slag being extracted, the slag is made up by using conventional fluxes of the limestone, sand, iron ore, sodium carbonate, etc. type. Addition can take place through the opening formed in the wall forming the top portion 8 and used for charging the carbon-containing compounds. However it is preferable to provide a special opening (not shown) for charging flux, said opening being pierced through the wall forming the top portion 8.

The appearance of gas above the slag produces gas pressure within the furnace, and said gas tends to escape via an orifice 18 formed through the wall constituting the top portion 8 of the furnace 2. An updraft of gas thus appears in the furnace and it is necessary for the lumps of carbon-containing compounds to be dense enough to be able to fall through the updraft and reach the molten slag 4 without being entrained by the gas.

The temperature of the gas is generally higher than 1100° C., and consequently in order to optimize the energy efficiency of the installation, at least part of the heat energy of said gas is recovered by passing the gas through a chamber 20 that includes a heat exchanger 22. The heat exchanger is constituted by a coil carrying a heat-conveying fluid suitable for actuating a turbine, for example.

The gas cools down on contacting the heat exchanger 22 and certain compounds, constituting said fourth fraction, condense, and in particular arsenic condenses at about 800° C. A space 24 is provided in the chamber 20 for storing the arsenic condensation dust. A second analogous chamber (not shown) can also be provided upstream from the first for allowing the dust that comes directly from the furnace 2 to settle. This dust can be recycled and reinserted as part of preparing the charge.

Once the gas temperature has dropped to about 200° C., the efficiency of the heat exchanger 22 becomes relatively poor and the gas is removed. It is passed through washing means 26 connected to the chamber 20 to eliminate the last traces of dust and also the unwanted gases so as to deliver a clean gas at an outlet 28. A main fan (not shown) is provided to drive the gas from the outlet 28 and direct it to a gas holder. The main fan is suitable for establishing suction at the end of the gasification installation, thus contributing to recovering the gases that come from the furnace.

The washing water is recycled through a purifier 30 and is then reused. Provision is also made to interpose a flare 32 so as to be able to burn off the gas in the event of an incident, and most particularly during start-up and closing-down stages.

A clean synthetic gas is thus obtained that is suitable for use as a fuel, but that could alternatively be used as raw material for producing various organic compounds.

Reference is now made to FIGS. 2, 3, and 4 in order to describe the bottom portion of the furnace in greater detail for a particular embodiment.

FIG. 2 is a vertical section view through the furnace 2 in which the wall forming the bottom portion of the furnace is pierced by an opening 34 leading to a tank 36, or fore-hearth in connection with the bottom portion of the furnace 2. The top of the fore-hearth 36 is open and its sides 38 are somewhat taller than the mean level of the bath of molten slag 4 in the furnace 2. It will be understood that the molten slag 4 reaches the fore-hearth 36 and that the level of the slag matches the level of the slag 4 in the furnace 2.

In this particular embodiment, the blast pipe 6 is inserted through the open top portion of the fore-hearth 36 and passes obliquely through the wall that is common to the bottom portion of the furnace 2 and to the fore-hearth 36 so that its end 40 opens out into the bath of molten slag in the furnace. The oxidizer is thus injected into the slag 4 in the furnace and diffuses up to its surface so as to enable the carbon-containing compounds to burn. This embodiment serves in particular to avoid problems associated with the joint between the blast pipe 6 and the furnace 2 when the blast pipe passes through the top portion of the furnace.

FIG. 4 shows the blast pipe 6, the furnace 2, and the fore-hearth 36 in a plan view on section plane IV—IV. The blast pipe 6 is to one side of the center of the furnace 2, so injecting oxidizer causes the molten mass to swirl, thus improving stirring and providing good circulation of slag 4 through the fore-hearth so as to ensure that the slag does not solidify therein. For this purpose, the orifice 42 in the wall through which the blast pipe passes is at least as large as the opening 34 pierced in the wall constituting the bottom portion of the furnace. Furthermore, as can be seen in FIG. 3, the opening 34 is also off-center and extends tangentially to the inside wall of the furnace so as to lead to a corner of the fore-hearth.

This configuration reduces the length of time molten slag 4 spends transiting through the fore-hearth and consequently reduces the risk of the slag solidifying therein. To further reduce this risk, the fore-hearth is advantageously provided with a lid (not shown) that presents an orifice through which the blast pipe passes.

The slag is drawn off at regular intervals or continuously through a channel 44 formed in the wall of the fore-hearth, and capable of being opened and closed under control. The slag is then granulated and can be used as aggregate or as a sand-blasting agent since the potential contaminants it contains are completely immobilized.

In addition, a drawing-off hole is provided at the bottom of the fore-hearth, which hole is normally plugged, and serves to eliminate a dense phase that forms and becomes deposited at the bottom of the bath of molten slag.

The invention is illustrated below by way of a comparative example in which three different compositions of oxidizer were injected into the molten slag. The example gives values for the amounts of energy that an installation of the invention can be expected to produce by varying the composition of the oxidizer.

The values and the compositions given below relate to a mixture comprising 70.6% wood and 29.4% pitch. The wood contained 15% moisture and 0.8% ash, and the "pitch" contained 80% pure pitch and 20% earth. To enable the earth to melt easily, appropriate corrections were made to the slag, e.g. by supplying iron oxide.

The data given below applies to consuming 4722 kilograms per hour (kg/h) of wood and pitch mixture, and drawing off 9 (metric) tonnes of slag per day using a furnace having a diameter of 2 m. Naturally, the slag was readjusted as a function of the quantity drawn off.

| | | | |
|---|---|---|---|
| Oxidizer % oxygen in air | 21 | 30 | 40 |
| stp gas production rate ($m^3$/h) | 14,499 | 11,099 | 9,468 |
| $H_2$ % | 14.3 | 21.2 | 26.3 |
| CO % | 21.6 | 30.4 | 36.9 |
| $CO_2$ % | 8.4 | 8.7 | 8.9 |
| $N_2$ % | 55.8 | 39.7 | 27.9 |
| Combustion temperature | 1399° C. | 1654° C. | 1794° C. |
| NCV in kcal/$m^3$ at stp | 980 | 1405 | 1719 |
| "Real" NCV Mcal/h | 14,209 | 15,594 | 16,275 |
| Steam kg/h | 7116 | 5499 | 4719 |

The greater the oxygen content of the oxidizer the smaller the quantity of gas that is produced. However, conversely, the gas that results from the transformation is richer in carbon monoxide and in hydrogen, thus giving it a greater net calorific value (NCV).

Nevertheless, the quantity of steam produced decreases with increasing oxygen, and above all oxygen is expensive and that needs to be taken into consideration in determining the overall efficiency of the installation.

In the above example, the method can be optimized easily by modulating the flow rate of oxygen and air. For some other composition of carbon-containing compounds, new adjustments of the oxidizer are necessary.

The invention claimed is:

1. A method of gasifying carbon-containing compounds optionally incorporating mineral elements and/or potential contaminants, comprising the following steps:

introducing, in the top portion of a furnace, at least said compounds, which are deposited on the surface of a bath of molten slag contained in the bottom portion of said furnace, and injecting, through a blast pipe inserted into said bath, an oxidizing gas into said bath so that the mixture of carbon-containing compounds and oxidizing gas is super-stoichiometric, whereby a first fraction of said compounds is pyrolyzed to produce synthetic gases, a second fraction is subjected to a combustion reaction delivering heat energy to said bath of slag in sufficient amount to maintain said bath in a fused state at a temperature comprised between 1100° C. and 1500° C., thereby enabling the pyrolysis of said first fraction, and a third fraction diffuses into said bath;

recovering, in said top portion of said furnace, at least said synthetic gases that are suitable for being used as fuel and that result from the pyrolysis and the combustion of said first and second fractions, and which appear above said molten slag; and cooling at least a portion of the molten slag so as to solidify it, thereby immobilizing at least a portion of said third fraction of said compounds containing at least the mineral element and/or the potential contaminants.

2. A gasification method according to claim 1, further characterized by preparing said compounds in the form of solid lumps so as to enable said lumps to be charged vertically over the bath of molten slag, whereby said lumps are deposited on the surface of said bath.

3. A gasification method according to claim 1, further characterized by simultaneously injecting said compounds and the oxidizer into the bath of molten slag.

4. A gasification method according to claim 1, characterized by simultaneously injecting said oxidizer and a fuel into said bath of molten slag to produce a combustion reaction whereby heat energy is delivered to said bath.

5. A gasification method according to claim 1, further characterized by condensing out a fourth fraction of said compounds as vaporized by the bath of molten slag.

6. A gasification method according to claim 1, further characterized by purifying said gases so as to obtain a clean fuel gas.

7. A gasification method according to claim 1, further characterized by recovering heat energy, in particular from said gas, so as to deliver heat energy to a heat-conveying fluid.

8. A gasification method according to claim 1, further characterized by adding fluxes in particular to the molten slag.

9. A gasification method according to claim 1, characterized in that the temperature of a portion of the molten slag is lowered by extracting said portion.

10. An installation for gasifying compounds, in particular carbon-containing compounds incorporating mineral elements and/or potential contaminants, the installation being characterized in that comprises:

a furnace for containing, in its bottom portion, a bath of molten slag;

means for introducing, in the top portion of said furnace, at least said compounds which are deposited on the surface of said bath of molten slag;

means for injecting at least oxidizer into said bath so that the mixture of carbon-containing compounds and oxidizer is super-stoichiometric whereby a first fraction of said compounds is pyrolyzed, a second fraction is subjected to a combustion reaction suitable for delivering heat energy to said bath of slag, and a third fraction diffuses into said bath;

means for recovering, in said top portion of said furnace, at least said synthetic gases that are suitable for being used as fuel and that result from the pyrolysis and the combustion of said first and second fractions, and which appear on top of said molten slag; and means for lowering the temperature of at least a portion of the molten slag so as to cause it to solidify, thereby immobilizing at least a portion of said third fraction of said compounds containing at least mineral elements and/or potential contaminants.

11. A gasification installation according to claim 10, characterized in that the bath of molten slag is contained in the bottom portion of a vertical cylindrical furnace having at least one opening pierced through the wall of the top portion of said furnace for charging it with said compounds, and at least one opening pierced through the wall of the bottom portion of said furnace for extracting at least a portion of the molten slag.

12. A gasification installation according to claim 10, characterized in that the means for charging said compounds comprise a feed screw opening out vertically above the bath of molten slag and provided with heater means whereby the compounds can agglomerate together by at least one of said compounds melting.

13. A gasification installation according to claim 10, characterized in that the means for injecting oxidizer into the molten slag comprise a blast pipe passing through the wall of the bottom portion of the furnace to open out into the bath of molten slag, and in which the oxidizer is under pressure.

14. A gasification installation according to claim 13, characterized in that the opening pierced through the wall of the bottom portion of said furnace leads to a tank adjacent to said furnace, having an open top and sides that come up at least to the mean level of the bath of molten slag contained in the bottom portion of said furnace, and in that said blast pipe is inserted into said open top portion and passes through the wall common to the bottom portion of the furnace and said tank so as to open out into the bath of molten slag.

15. A gasification installation according to claim 10, characterized in that the means for injecting oxidizer into the molten slag comprise a blast pipe passing through the wall of the top portion of the furnace and penetrating into the bath of molten slag, and in which the oxidizer is under pressure.

16. A gasification installation according to claim 11, characterized in that the wall of the top portion of the vertical furnace is pierced by an orifice for collecting at least the gases derived from the pyrolysis and the combustion of said first and second fractions, and in that said installation further comprises washing means connected to said orifice in order to purify said gas.

17. A gasification installation according to claim 16, characterized in that a heat exchanger and deposition chambers are interposed between the furnace and the washing means so as to recover at least part of the heat energy from said products and so as to recover in condensed form a fourth fraction of the compounds which are vaporized within the furnace.

18. A gasification method according to claim 2, further characterized by:

simultaneously injecting said compounds and the oxidizer into the bath of molten slag;

simultaneously injecting said oxidizer and a fuel into said bath of molten slag to produce a combustion reaction whereby heat energy is delivered to said bath;

condensing out a fourth fraction of said compounds as vaporized by the bath of molten slag.

19. A gasification method according to claim 18, further characterized by:

recovering heat energy, An particular from said gas, so as to deliver heat energy to a heat-conveying fluid;

adding fluxes in particular to the molten slag;

the temperature of a portion of the molten slag being lowered by extracting said portion.

20. A gasification installation according to claim 11, characterized in that:

the means for charging said compounds comprise a feed screw opening out vertically above the bath of molten slag and provided with heater means whereby the compounds can agglomerate together by at least one of said compounds melting;

the means for injecting oxidizer into the molten slag comprise a blast pipe passing through the wall of the bottom portion of the furnace to open out into the bath of molten slag, and in which the oxidizer is under pressure;

the opening pierced through the wall of the bottom portion of said furnace leads to a tank adjacent to said furnace, having an open top and sides that come up at least to the mean level of the bath of molten slag contained in the bottom portion of said furnace, and in that said blast pipe is inserted into said open top portion and passes through the wall common to the bottom portion of the furnace and said tank so as to open out into the bath of molten slag.

21. A gasification installation according to claim 12, characterized in that:

the means for injecting oxidizer into the molten slag comprise a blast pipe passing through the wall of the top portion of the furnace and penetrating into the bath of molten slag, and in which the oxidizer is under pressure;

the wall of the top portion of the vertical furnace is pierced by an orifice for collecting at least the gases derived from the pyrolysis and the combustion of said first and second fractions, and in that said installation further comprises washing means connected to said orifice in order to purify said gas;

a heat exchanger and deposition chambers are interposed between the furnace and the washing means so as to recover at least part of the heat energy from said products and so as to recover in condensed form a fourth fraction of the compounds which are vaporized within the furnace.

22. The method of claim 1, further comprising wherein the carbon-containing compounds are selected from the group consisting of carbochemistry and petrochemistry residues, bituminous shales, wood, treated wood, hydrocarbons, pitch and mixtures thereof.

23. The method of claim 22, further comprising wherein the treated wood comprises one or more of wood used in posts for supporting electricity and/or telephone lines, wood used in railway sleepers, wood treated with hydrosoluble salts or oxides selected from the group consisting of copper, chromium and arsenic salts or oxides, and wood treated with creosote.

24. The method of claim 1, further comprising wherein the gas is recovered at a temperature which is over 1100° C.

* * * * *

UNITED STATES PATENT AND TRADEMARK OFFICE

CERTIFICATE OF CORRECTION

PATENT NO. : 7,087,098 B2
APPLICATION NO. : 10/148753
DATED : August 8, 2006
INVENTOR(S) : Andre Garnier et al.

It is certified that error appears in the above-identified patent and that said Letters Patent is hereby corrected as shown below:

Column 11, claim 19, line 1, “An particular” should read --in particular--.

Signed and Sealed this

Fifteenth Day of April, 2008

JON W. DUDAS
*Director of the United States Patent and Trademark Office*